United States Patent [19]

Gaukel

[11] Patent Number: 4,933,652

[45] Date of Patent: Jun. 12, 1990

[54] TEM COAXIAL RESONATOR

[75] Inventor: Kevin M. Gaukel, Tempe, Ariz.

[73] Assignee: Celwave Systems Inc., Phoenix, Ariz.

[21] Appl. No.: 335,388

[22] Filed: Apr. 10, 1989

[51] Int. Cl.[5] ..... H01P 7/04

[52] U.S. Cl. ..... 333/225; 333/226; 333/235

[58] Field of Search ..... 333/206–208, 333/222–226, 234, 235

[56] References Cited

U.S. PATENT DOCUMENTS

| | | | |
|---|---|---|---|
| 2,637,782 | 5/1953 | Magnuski | 333/208 |
| 2,918,636 | 12/1959 | Shapiro | 333/226 X |
| 4,034,320 | 7/1977 | Heckman, Jr. et al. | 333/225 |
| 4,207,548 | 6/1980 | Graham et al. | 333/225 |
| 4,460,878 | 7/1984 | Fouillet et al. | 333/226 X |
| 4,521,754 | 6/1985 | Ranghelli et al. | 333/226 X |

*Primary Examiner*—Eugene R. LaRoche
*Assistant Examiner*—Seung Ham
*Attorney, Agent, or Firm*—Kenneth R. Bowers

[57] ABSTRACT

A coaxial resonance cavity of either the fingered or unfingered variety having a metal heat conducting barbell shaped structure inside the movable tuning plunger to conduct heat from the inner surface of the movable plunger to the inner surface of the fixed stub or directly to the shield to provide for a heat conductive path to the shield to carry heat away from the inner plunger. The barbell is an integral structure machined from stock aluminum, but resembles three right circular cylinders butting end to circular end. The upper cylinder has a diameter appropriate to maintain tight contact with the stub. The lower cylinder has a smaller diameter, appropriate to maintain contact with the movable plunger. The central cylinder has a diameter which is sufficiently small to avoid contact with any portion of friction buttons located on the side of the plunger to serve as a spacer between the plunger and the stub, especially such portion of the button which may extend entirely through the plunger for support of the button.

7 Claims, 2 Drawing Sheets

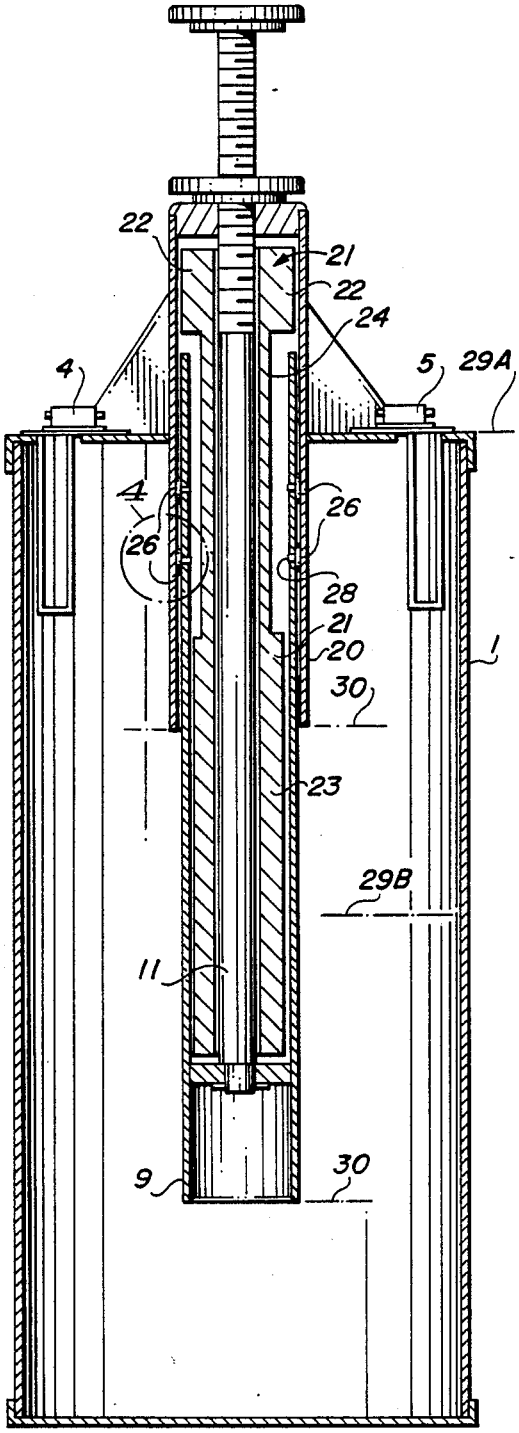
FIG. 1
FIG. 1A
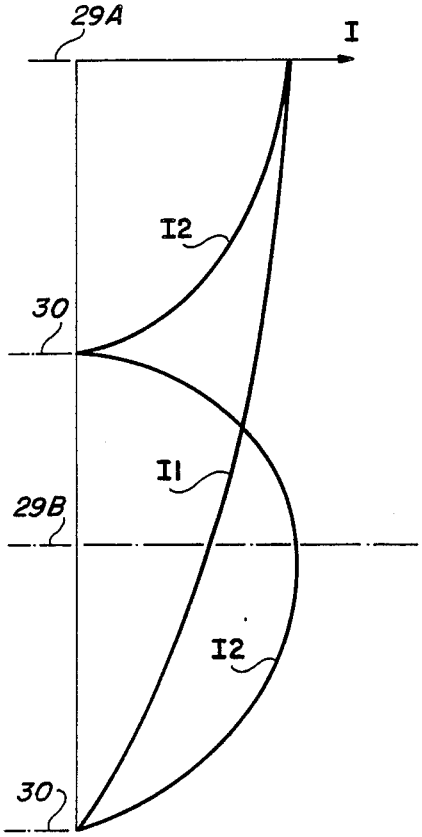
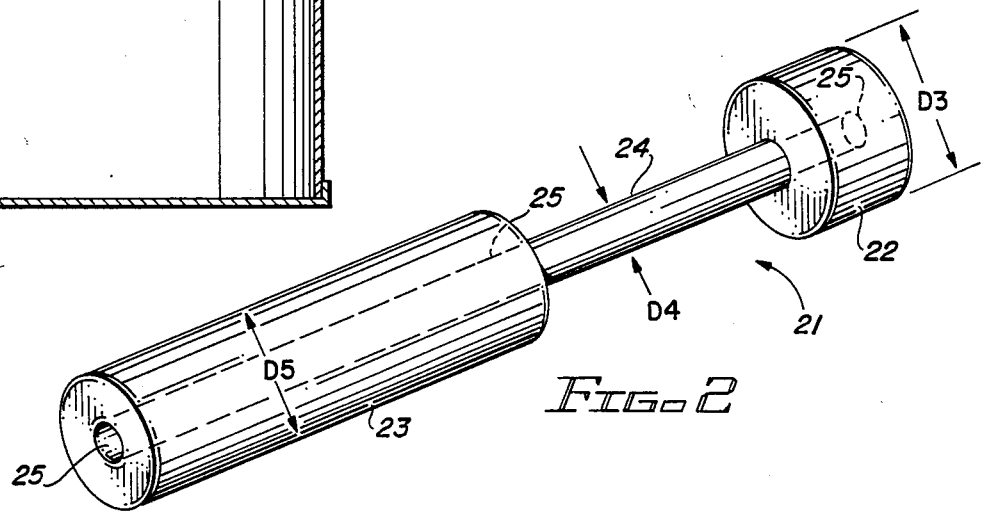
FIG. 2

TEM COAXIAL RESONATOR

BACKGROUND

1. Field of the Invention

This invention relates to coaxial transverse electromagnetic wave resonators.

2. Prior Art

A transverse electromagnetic wave resonator (hereinafter "TEM resonator") is an electromagnetic filter which is used to discriminate against all but one electromagnetic frequency. Coaxial resonators are described in U.S. Pat. No. 4,207,548 to Graham et al., and U.S. Pat. No. 2,637,782 to H. Magnuski. The resonator is basically a cylindrical can containing a central conductor. The outer can has an input electrode at which an electrical signal is introduced, having a range of frequencies. The can also has an output electrode at which a single frequency appears, depending on the length of the central conductor. The central conductor is often adjustable in length to enable frequency tuning. Refer to the Graham et al. reference for the remainder of this section, except as otherwise directed to the Magnuski reference, especially for the identity of reference numerals. The outer conductor 1 is a cylindrical can, having input and output terminals 4 and 5 respectively. The conductor 1 contains a fixed tubular outer conductor 20 which includes therein a slidable inner plunger 9. A rod 11 is fixed to plunger 9 and can be rotated to advance plunger 9 downward through conductor 20 or conversely, can be rotated to shift plunger 9 upward through conductor 20. To the extent that plunger 9 advances beyond the end of conductor 20, the apparent length of the central conductor is increased, tuning the frequency of resonance of the filter. Movement of plunger 9 is impelled by a rod 11 which is made of a metal having low electrical conductivity such as Invar.

The outer conductor has a cavity therein which can be considered to be electrically equivalent to a length of coaxial cable that is shorted from its inner conductor to the outer conductor (or shield) at one end and left open on the other end. At the shorted end, the voltage on the inner conductor equals the shield voltage, which is defined as zero, or ground potential. If a current develops on the inner conductor, it will have a maximum value at the short. At the open end, the current on the inner conductor is zero, and the voltage between the inner and outer conductor is at a maximum. The distance between these events on a cable is directly related to a distance a voltage maximum travels in a second (the wave velocity) and the frequency of the wave. The ratio of the velocity to frequency is defined as the wavelength, and it is also the physical distance between two wave maxima in a continuously repeating wave.

In the structure of the filter, the short must occur at the shorted end and the open must occur at the open end. The frequency and the velocity of the wave, mutually independent conditions, determine the distance between the open and the short for a given wavelength. At a given length between the open and the short, a discrete primary wavelength will resonate, having a current maximum at the short and a current minimum at the open. Since the velocity of the wave is set by the material between the inner and outer conductor, resonance will occur only at discrete frequencies determined by the ratio of the velocity of the wave in the cable to the resonance wavelengths. Thus the structure functions as a frequency selective device or resonator.

The most basic resonator is defined as a quarter wave resonator. A quarter wave resonator has exactly one current maximum and one current minimum, separated by a distance equal to one-quarter wavelength. The details of such a resonator are described in the Magnuski reference. The length of the central conductor of a quarter wave resonator should be adjusted to be exactly one-quarter of the wavelength of the desired resonance frequency.

There are an infinite number of resonances in addition to the basic quarter wave field pattern that can occur in a coaxial cavity TEM resonator which is grounded at one end and open at the other. The current along the inner conductor of the resonator is difficult from the basic quarter wave resonance in that there is an additional current maximum for each resonance above the basic resonance. In a quarter wave resonator, the only maximum occurs at the shorted end at the base of the fixed section, (20 in Graham et al.) In a three quarter wave cavity, there are two maximum field points, one at the short and one at half wavelength distance from the short. Thus there are two maximum current points along the inner conductor of a three quarter wave cavity, yet the conditions of the unit having a current maximum at the shorted end, and a current minimum on the open end are still met. This is called a harmonic mode or a higher-order mode of operation. The length of the central conductor of a three-quarter wave cavity should be adjusted to be three fourths of the wavelength of the desired resonance frequency. When the coaxial resonator is used in an environment in which the temperature varies over a wide range, the inner conductor length must be held constant by some type of temperature compensation device. Magnuski teaches such compensation.

Refer to the Magnuski patent for the remainder of this paragraph. When the temperature of the entire resonator increases equally, rod 46 expand, causing the length of the overall inner conductor (stub 44 and plunger 45) to initially increase. At the same time, a compensating tower 51 expands in the opposite direction. Tower 51 is mechanically connected to a threaded assembly 49 which holds threaded rod 46 in place. The expansion of the tower counters the expansion of the rod, thus keeping the length of the inner conductor virtually unchanged. The drift in the frequency of resonance due to a temperature change is calculated as:

$$F_t/F_o = K^*(L_{tower}{}^*A_{tower} - L_{rod}{}^*A_{rod})^*T$$

Where $F_t$ is the frequency drift of the cavity;

$F_o$ is the resonance frequency;

K is the change in frequency normalized to Fo versus the change in inner conductor length;

$L_{tower}$ is the length of the tower;

$L_{rod}$ is the length of the rod;

$A_{tower}$ is the linear coefficient of expansion of the tower material;

$A_{rod}$ is the linear coefficient of expansion of the rod material; and

T is the change in temperature.

As an example, consider a resonator having a copper tower 51 and a rod 46 made of a low expansion alloy known as INVAR.

Accordingly, $A_{tower}$ is 9.3 ppm/degree F.; $A_{rod}$ is 0.86 ppm/degree F.

$$F_t/F_o=K*(9.3*L_{tower}-0.86*L_{rod})*T$$

Chose a tower height such that $L_{tower}=0.092*L_{rod}$, and it can be seen that $F_t=0$. Therefore, the resonator will maintain a constant inner conductor length during ambient temperature changes and the drift in resonance frequency will be zero. If the tower and the rod are at the same temperature, there will be no frequency drift. However, in applications in which very high radio wave power levels are filtered, the assumption of equal tower and rod heating is invalid. If the input signal is of high power, the resistance heating in the central conductor can be significant. At the points along the conductor where maximum magnetic fields exist, there also maximum current also occur are localized heating is at a maximum. In the case of a quarter wave resonator, the peak currents occur on the fixed section 20 of the central conductor, also known as the stub. Since changes in the length of the fixed stub does not alter the overall length of the inner conductor, a heatup of the stub does not greatly alter the resonance frequency. The fixed stub is also in good thermal contact with tower and shield 1, further reducing the effects of thermal changes. Plunger 9, in contrast, is not generally in contact with any heat sink. Rod 11 is generally made of INVAR, a very poor heat conductor. Rod 11 is long and of small cross-section, reducing its ability to transfer heat from plunger 9.

In FIG. 1, inner plunger 9 is separated from stub 20 by a plurality of spacers labeled 19 and reference point B. These spacers 19 are generally of a plastic material and serve to prevent electrical contact between stub 20 and plunger 9. Spacers 19 conduct heat poorly.

Refer to FIG. 4 of Magnuski. In this Figure, the filter has a stub 44, and a movable plunger 55, both connected together electrically via fingers 56. The Magnuski device does not have the spacers 19 of Graham et al. Fingers 56 are metal and therefore conduct heat.

The Magnuski device is said to be "fingered" while the Graham et al. device is said to be "unfingered". Generally speaking, the fingered device enjoys better heat conduction between the stub and the plunger.

Both in the case of fingered and unfingered resonators, the mechanism by which heat is transferred away from the movable inner plunger 9 is mostly heat conduction in the gas surrounding the inner conductor. Very little heat is transferred by conduction through the stub (via fingers if present) or through the controlling rod 11.

In the case of a quarter wave resonator, most of the heat deposited in the inner conductor is deposited along the length of the inner conductor comprised by the fixed stub because the current maximum occurs at the short. In the case of the three quarter wave resonator, there is a current maximum which occurs along the portion of the inner conductor which is comprised by the movable plunger. A large amount of heat is deposited in the plunger, which has poor heat communication with the fixed stub, or with any other heat path leading to the tower. Consequently, a three quarter wave resonator may demonstrate poor response to temperature changes in that the resonance frequency will drift during temperature changes, both in fingered and unfingered configurations.

It is an object of this invention to improve the thermal stability of resonance cavities, especially three quarter wave resonance cavities.

SUMMARY OF THE INVENTION

The invention is a resonance cavity which may be either fingered or unfingered, especially for three-quarter wave operation, having bar-bell shaped inner conductor disposed within the movable plunger. The bar bell geometry is approximately that of two relatively large metallic cylinders connected by a metallic rod of diameter less than that of the barbell end cylinders. A first cylinder is arranged at the site of the current maximum of the three quarter wave which occurs opposite the movable plunger. The second cylinder is either in good thermal contact with the heat compensating tower or may be an integral part thereof. The connecting bar transfer heat generated by the current maximum to the tower, improving the thermal stability of the resonator.

The first cylinder has a diameter appropriate to slide within the movable plunger and make intimate thermal contact with it without preventing its free sliding upward and downward. The diameter of the connecting bar is less than the diameter of the first cylinder by an amount sufficient to permit structures on the inside cylindrical surface of the movable plunger to slide upward and downward with the plunger without contacting the connecting bar.

The structures on the inner surface of the plunger may in particular be supporting tabs which are an integral part of buttons located on the outside cylindrical surface of the plunger and which buttons serve as spacers to separate the plunger from the stub. The tabs snap into holes in the plunger and fix the button in place. Extending through the plunger wall, the tab does not contact the connecting bar due to its reduced diameter with respect to the first cylinder.

BRIEF DESCRIPTION OF THE DRAWINGS

FIG. 1 is a side sectioned elevation of a coaxial resonator of the unfingered type depicted in the Graham et al. reference having the invented barbell shaped heat conductor inserted and having an opposed schematic diagram (FIG. 1A) which relates current maximum positions to the axial geometry of the resonator;

FIG. 2 is a perspective view of the barbell heat conductor;

DETAILED DESCRIPTION

Figure 3:
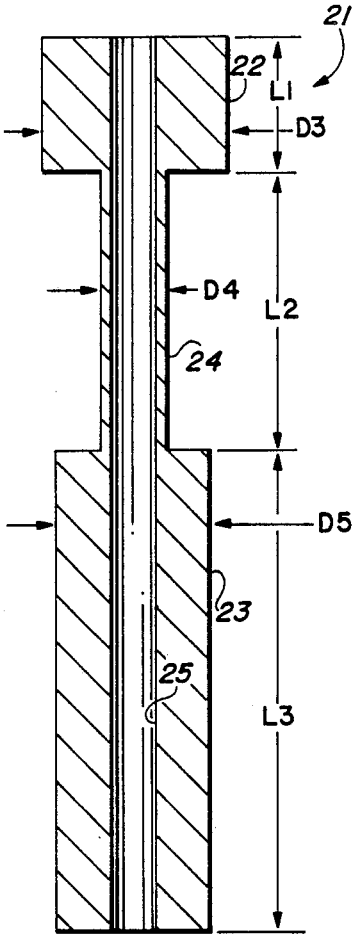
FIG. 3 is a side sectioned elevation of the barbell heat conductor.

This description will teach the use of a heat conductor installed inside the movable plunger of a coaxial resonator to provide for heat conduction from the movable plunger to the fixed stub or to the shield.

While the following specification is intended to be complete, the U.S. patents to (A) Graham et al., U.S. Pat. No. 4,207,548, issued Jun. 10, 1980 and (B) H. Magnuski, U.S. Pat. No. 2,637,782, issued May 5, 1953 are incorporated herein by reference.

In this specification, in the claims, and in the drawings, similar numerals refer to similar features. Additionally, the numerals in this specification which are similar to numerals in the Graham et al. reference denote similar features.

Refer to FIG. 1 of Graham. A cylindrical metallic shield 1 surrounds the inner conductor formed by a fixed stub 20 and a movable plunger 9. Both stub 20 and plunger 9 are metallic cylinders and plunger 9 is movable upward and downward through stub 20 such that the overall length of the inner conductor can be adjusted by movement of a INVAR rod 11. Fixed stub 20 is attached to shield 1. Note input and output electrical terminals 4 and 5.

FIG. 1 herein is adapted from FIG. 1 of Graham et al. Support 16 is removed and the top spacers 19 are replaced by Teflon buttons 26, four being the preferred number as shown. A barbell shaped heat conductor 21, hereinafter "barbell" 21, is added to the resonator. Barbell 21 has three sections; a first, upper cylinder 22, which is a right circular cylinder having a circular diameter D3 and height L1; a second, lower cylinder 23, which is a right circular cylinder having a circular diameter D5 and a height L3; and a connecting barbell rod 24, which is a right circular cylinder having a circular diameter D4 and a height L2. Rod 24 connects upper cylinder 22 to lower cylinder 23. In practice, the entire barbell 21 may be an integral whole, and may be machined from a common bar of material. Since barbell 21 serves as a heat sink and heat conductor, it is composed of a material having a high thermal conductivity, such as a metal, especially Aluminum. Barbell 21 is illustrated in FIGS. 2 and 3 which also show that a hole 25 extends throughout barbell 21 through the three cylinders 22,23, 24 along the common axis of the three cylinders. FIG. 1 shows how barbell 21 fits inside the resonator. Barbell 21 is inserted inside plunger 9 with rod 11 passing through hole 25. In FIG. 1, for clarity, there is shown some clearance between upper cylinder 22 and the inner surface of stub 20, but in practice D3, the diameter of upper cylinder 22, is chosen to cause tight contact between upper cylinder 22 and stub 20. FIG. 1 also shows clearance between lower cylinder 23 and the inner surface of plunger 9. In practice, D5, the diameter of lower cylinder 25, is chosen such that lower cylinder 25 makes contact with plunger 9 but does not prevent plunger 9 from sliding up and down.

Figure 4:
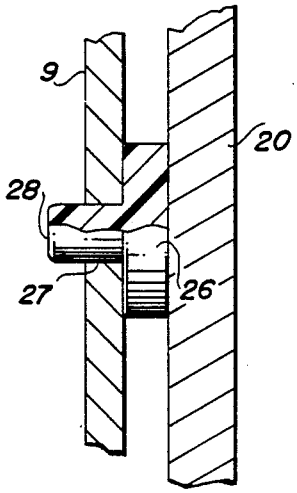
FIG. 4 is a detail from FIG. 1.

As seen in FIGS. 1 and 4, Teflon buttons 26 serve as spacers between plunger 9 and stub 20. Buttons 26 are fixed to plunger 9 by insertion through a hole in the side of plunger 9. As plunger 9 moves up and down to tune the frequency of resonance of the cavity, buttons 26 are in sliding contact with stub 20. The portion of button 26 which extends through the hole in plunger 9 is labeled tab 27 in FIG. 4. Tab 27 has a rear surface 28 which extends into the gap between plunger 9 and rod 24. Diameter D4 of Rod 24 is chosen such that rod 24 does not make contact with surface 28 of button 26. Also, length L2 of rod 24 is chosen such this lack of contact holds true over the entire range of travel of plunger 9.

Diameter D3 is the largest diameter of the set of three including D3, D4, and D5. Height L1 is chosen to be sufficiently large that the contact between upper cylinder 22 and stub 20 is supportive of barbell 21 to prevent wobble at the lower end of lower cylinder 23. Upper cylinder 22 may be attached to Plunger 9 by screws or by other means.

If tab 27 of button 26 does not extend beyond the rear surface of plunger 9, that is to say that surface 28 is at least flush with the surface of plunger 9, then there is no need for the diameter of rod 24 to be less than the diameter of lower cylinder 23. In that case, D4 and D5 may be equal, and barbell 21 can be said to comprise two cylinders.

Refer to FIG. 1A. This figure is a graph of resonator current I versus position Z for a quarter wave I1 and for a three quarter wave I2. Numeral 29 relates to the position of current maximum points while numeral 30 relates to positions of minimum current. Of course, position 29 can be expected to be a point of highest temperature in the inner conductor and the shape of the current curve is the approximate distribution of heat deposition in plunger 9. Note that hot spot 29B is opposite lower cylinder 23. Length L3 is chosen such that lower cylinder 23 is always disposed opposite hot spot 28B to greatly reduce the temperature.

Barbell 21 functions to conduct heat deposited in plunger 9 to shield 1. The path for heat transfer begins in plunger 9 and passes to lower cylinder 23 via the surface contact between lower cylinder 23 and plunger 9. Heat is conducted upward through rod 24 to upper cylinder 22 and then to stub 20. Heat is transferred from stub 20 to shield 1. There is no contact between rod 11 and barbell 21 because the size of hole 25 is greater than the diameter of rod 11. Rod 11 does not serve to transfer much heat.

Figure 5:
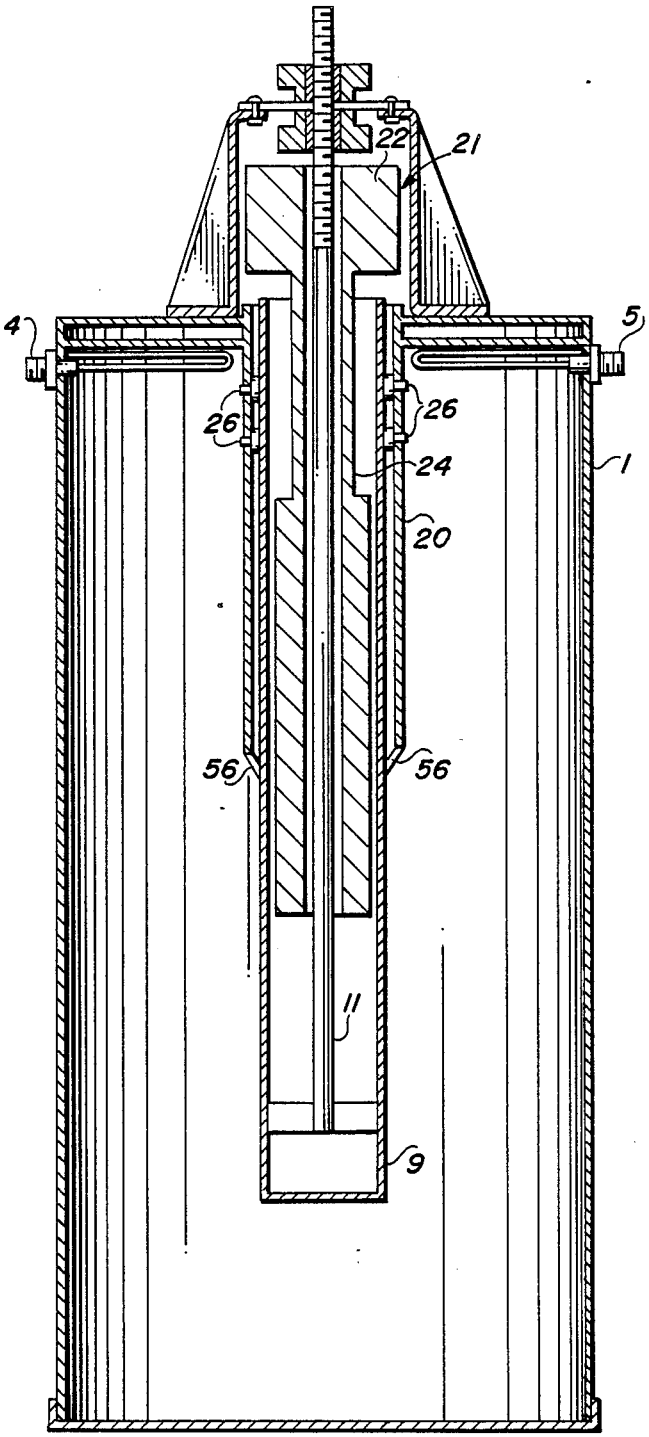
FIG. 5 is a side sectioned elevation of a coaxial resonator of the fingered type as shown in the Magnuski reference, having added thereto the invented barbell shaped heat conductor.

Refer to FIG. 5 which is an adaptation of FIG. 4 of Magnuski. Magnuski teaches a fingered type of resonator. Barbell 21 is shown installed in the resonator as described as adapted for the Graham et al. device, but in this case upper cylinder 22 is in contact with tower 51. Heat is conducted from barbell 21 to tower 51 to shield 40. It is feasible to manufacture barbell 21 and tower 51 as a single integral whole.

While in this specification and in the claims, a general and two specific devices have been described, it should be understood that modifications to the concept of a central conductor added to a coaxial resonator to conduct heat from the movable plunger to the shield or to the fixed stub can be envisioned without departure from the true spirit and scope of the invention. Therefore the specification should be considered illustrative rather than limiting and such modifications should be considered routine engineering rather than invention.

I claim:

1. A coaxial cavity resonator comprising a first, outer conductor shield (1) hollow structure, a second, inner conductor internally disposed in a coaxial relationship with said first conductor and in a short-circuit connection at one end thereof with one end wall of said first conduction and in an open-circuit relationship with the other end wall of said first conductor, said second inner conductor comprising a tubular stub (20) fixed at said short-circuited end to said first outer conductor, a tubular slidable plunger (9) extending through said stub, said plunger slidable into and out of said stub to alter the overall length of said inner conductor to alter the frequency of resonance of said resonator wherein said second inner conductor contains a tubular heat-conductive barbell (21) of heat conductive material, said barbell in thermal contact at a first barbell end with said short-circuited end of said second conductor and said barbell in thermal contact at a second barbell end with said plunger at said open-circuited end of said second conductor.

2. The resonator of claim 1 wherein said barbell has a hole (25) therethrough for passage of a rod (11) attached to said plunger at said open circuited end of said second conductor, said rod adopted to control and impel sliding movement of said plunger, said rod thereby said hole not in contact with said barbell.

3. The resonator of claim 1 wherein said barbell comprises a first right circular cylinder of circular diameter D3 and a second right circular cylinder of circular diameter D5 wherein said first cylinder is in thermal contact with said second conductor at said short-circuited end because D3 is approximately equal to the internal diameter of said stub and said second cylinder is in thermal contact with said plunger because D5 is approximately equal to the internal diameter of said plunger.

4. The resonator of claim 1 wherein said plunger has attached thereto at least one button (26) which is in frictional contact with said stub, said button extending through the thickness of said plunger toward said barbell.

5. A coaxial cavity resonator comprising a first, outer conductor shield (1) hollow structure, a second, inner conductor internally disposed in a coaxial relationship with said first conductor and in a short-circuit connection at one end thereof with one end wall of said first conductor and in an open-circuit relationship with the other end wall of said first conductor, said second inner conductor comprising a tubular stub (20) fixed at said short-circuited end to said first outer conductor, a tubular slidable plunger (9) extending through said stub, said plunger slidable into and out of said stub to alter the overall length of said inner conductor to alter the frequency of resonance of said resonator wherein said second inner conductor contains a tubular heat conducting barbell (21) of heat conductive material, said barbell in thermal contact at a first barbell end with said short-circulated end of said second conductor and said barbell in thermal contact at a second barbell end with said plunger at said open-circuited end of said second conductor, wherein said barbell comprises a first right circular cylinder of circular diameter D3 and a second right circular cylinder of circular diameter D5 wherein said first cylinder is in thermal contact with said second conductor at said short-circuited end because D3 is approximately equal to the internal diameter of said stub and said second cylinder is in thermal contact with said plunger because D5 is approximately equal to the internal diameter of said plunger, wherein said plunger has attached thereto at least one button (26) which is in frictional contact with said stub, said at least one button having a tab extending through the thickness of said plunger toward said barbell, wherein said barbell additionally comprises a third circular cylinder having a circular diameter chosen to be sufficiently small that said barbell third cylinder during juxtaposition with said at least one button due to sliding movement of said plunger does not make contact with said at least one button tab.

6. The resonator of claim 1 wherein said barbell is in thermal contact with said shield at said short-circuited end of said second conductor.

7. The resonator of claim 5 wherein said barbell is in thermal contact with said shield at said short-circuited end of said second conductor.

* * * * *